United States Patent [19]

Ashworth

[11] 4,162,190

[45] Jul. 24, 1979

[54] PAPER MAKERS WET FELTS

[75] Inventor: Gordon Ashworth, Burnley, England

[73] Assignee: Scapa-Porritt Limited, Blackburn, England

[21] Appl. No.: 823,020

[22] Filed: Aug. 8, 1977

Related U.S. Application Data

[63] Continuation of Ser. No. 633,106, Nov. 18, 1975, abandoned, which is a continuation of Ser. No. 465,315, Apr. 29, 1974, abandoned.

[51] Int. Cl.[2] ..... D21F 7/08; D21F 7/12

[52] U.S. Cl. ..... 162/359; 162/358; 428/280; 428/282; 428/288; 428/300; 34/95

[58] Field of Search ..... 162/358, 359, 205, 206; 428/246, 280, 282, 286, 288, 289, 300; 34/95, 243 F; 139/383 A

[56] References Cited

U.S. PATENT DOCUMENTS

| | | | |
|---|---|---|---|
| 2,943,379 | 7/1960 | Foltz, Jr. | 162/358 X |
| 3,214,326 | 10/1965 | Lee | 162/358 X |
| 3,214,327 | 10/1965 | Wicker et al. | 162/358 X |
| 3,329,554 | 7/1967 | Hencken | 34/95 X |
| 3,392,079 | 7/1968 | Fekete | 428/300 X |
| 3,401,467 | 9/1968 | Koester | 34/95 |
| 3,545,442 | 12/1970 | Wicker et al. | 428/300 X |
| 3,664,905 | 5/1972 | Schuster | 428/282 X |

*Primary Examiner*—Richard V. Fisher
*Attorney, Agent, or Firm*—Karl F. Ross

[57] ABSTRACT

A paper making apparatus of the type having a movable endless belt which conveys a wet web of paper between a pair of pressure rollers for driving water out of the web and then passing the web to a drying zone. A surface layer of the belt is formed from a water-absorbent nonwoven fiber material and a backing layer is provided which is coarser than the surface layer and is formed from water-absorbent wads of separate fibers. The surface layer has hydrophobic properties such that the surface layers has a critical surface tension less than 33 dynes per centimeter and is held in intimate contact with the backing layer by fibers of the surface layer which penetrate and are needled into the backing layer. The layers are thus so integrated that water forced into the surface layer by the pressure rollers is readily taken up by both layers to be retained thereby.

9 Claims, 2 Drawing Figures

PAPER MAKERS WET FELTS

This application is a continuation of Ser. No. 633,106 (now abandoned) filed Nov. 18, 1975 as a continuation of Ser. No. 465,315, filed Apr. 29, 1974, also abandoned.

This invention relates to paper-makers' wet felts which are endless belts or bands of water absorbent fibrous material used for conveying a wet paper web, delivered by a wet-type paper-making machine, from a forming zone, through a pressing zone, to a drying zone.

At the pressing zone there is usually provided rotating cylindrical squeeze rolls between which the freshly formed paper web is passed. As the web enters the nip of the rolls, water is squeezed from the paper and is accepted by the wet felt on which the paper is conveyed through the nip.

A well known kind of paper-makers' felt is a "Batt-on-Base" material, that is, it comprises a batt of loosely associated textile fibers needled to a woven base or backing cloth. such a felt is described in British Pat. No. 939933 and reference is made thereto for further description of the construction and manner of manufacture thereof.

The conventional "Batt-on-Base" felts are formed from materials such as wool, nylon, Perlon, Terylene and the like and with such felts the paper web after passing through the nip of the pressing rolls usually still contains an appreciable amount of water which adds substantially to the manufacturing costs due to the high power required to evaporate the water during the subsequent drying stage.

According to the present invention there is provided a paper-makers' felt, for accepting water from a wet web of paper, comprising an endless belt or band of water absorbent fibrous material, characterized in that the belt consists of or includes a layer having hydrophobic characteristics such that critical surface tension of the layer is less than 33 dynes/cm.

With a belt of this nature, when used to convey a freshly formed paper web through the nip of pressing rolls, it has been found that the amount of water remaining in the paper on emergence from the nip can be much reduced. One possible reason for this is that, due to the hydrophobic nature of the said layer, there is a reduced tendency for water taken-up by the belt or band to be returned to the paper web by capillary action.

Preferably, the critical surface tension of the hydrophobic layer is less than 28 dynes per cm. Values of critical surface tension given herein are in relation to conditioned material (at 20° C. and 65% relative humidity). Surface tension can change on continued immersion in water and/or exposure to mechanical action.

The hydrophobic layer may form the whole felt or alternatively may be only part thereof but in each case the outer surface of the layer preferably constitutes the outer surface of the felt. The invention is not however restricted to this feature since in some cases it may be desirable to cover the hydrophobic layer with a layer of hydrophilic (or less hydrophobic) material.

In the case where the hydrophobic layer forms only part of the felt, said layer will preferably be backed with a hydrophilic (or less hydrophobic) layer. With this arrangement, advantageously, some of the water forced mechanically, in the nip of the pressure rollers, into the hydrophobic layer will tend to pass into the hydrophilic layer and be retained therein. The thickness of the hydrophobic layer will be selected in accordance with requirements and the nature of the materials used in the felt, and in some cases may be present in an amount as little as 65 g/m$^2$.

The hydrophilic (or less hydrophobic) back-up layer may be formed from wool or any of the synthetic fibers customarily used in paper makers' felts, and it may be in the form of a fabric, such as a woven fabric, or alternatively, a wad of separate fibers.

The hydrophobic layer may be secured to a supporting backing layer, being a self-supporting fabric or the like. Said backing layer may constitute or may be provided additionally or alternatively to the aforementioned hydrophilic layer. The supporting layer may be a woven fabric such as is customarily used in a paper makers' felt, and the hydrophobic layer, and also the hydrophilic (or less hydrophobic) layer where this is provided and is separate to the backing layer, may be secured to the backing layer by a conventional needling technique. Reference is made to the already mentioned prior British Patent Specification No. 939933 for a description of needling techniques. The invention is not however restricted to this method of securing the hydrophobic layer to a backing layer and other methods may be used, for example, employing adhesives or binders.

The hydrophobic layer need not be backed solely by hydrophilic materials but instead may be backed by a layer or layers of hydrophobic material differing from the hydrophobic layer with regard to the degree of hydrophobicity (e.g. the backing layer or layers may be less hydrophobic) and/or with regard to the physical constitution thereof. Thus, for example, a felt may have the hydrophobic layer provided on the outer surface of the felt and formed from a fine denier (e.g. 3 denier) material and a backing layer may be provided which is of a coarser denier (e.g. 12 denier). With this arrangement a relatively fine, smooth surface is presented to the paper whilst the coarser backing layer (which in accordance with its large denier will usually have larger spaces therein) gives good water removal properties. This arrangement is particularly important where the felt is formed wholly or largely from hydrophobic fibers since in this case a relatively coarse layer of fibers is required to ensure that the felt does not present an excessively high hydraulic resistance.

Where the hydrophobic layer is backed by a hydrophilic (or less hydrophobic) layer, both such layers may have internal spaces of similar sizes or alternatively of dissimilar sizes.

In general, the fiber denier in the hydrophobic layer and in any backing layer and also the inter-fiber space size will be selected in accordance with requirements and in dependence on the nature of materials used, to give desired physical properties such as strength, resilience, water flow and retention properties and surface texture.

A felt according to the invention need not incorporate a supporting layer for the hydrophobic fibers, but instead the fibers may be so associated, as by weaving, etc., or may be secured together, for example by an adhesive or binder, as to constitute a self-supporting layer.

The felt of the invention will normally have a thickness at 40 KN m$^{-2}$ of 1.8–4.5 mm, and at 2000 KN m$^{-2}$ of 0.8–2.5 mm. The weight will normally be 600–2000 g/m$^2$ more usually 850–1400 g/m$^2$.

The hydrophobic characteristics may be attained in any suitable manner.

Thus, for example, fibers formed from an intrinsically hydrophobic material may be employed, such as polytetrafluoroethylene (PTFE), fluorinated ethylene propylene copolymer and polyolefin fibers. These materials may be used alone or blended with each other or with any other suitable material (for example, PTFE fiber blended with a polypropylene fiber may be used).

Alternatively, fibers may be rendered hydrophobic (or more hydrophobic) by treatment with appropriate materials such as polysiloxanes or fluor compounds such as are conventionally used for rendering materials water repellant. Materials of this kind are held to the fibers by means of an adhesive bond. This is not wholly satisfactory in all cases since the rigorous conditions to which the felt is exposed in use may cause disruption of the bond in time. Instead, where hydrophobic properties are imparted by treatment with a material it is preferred that the treatment should be such as to ensure a powerful long-lasting bond between the fiber and the material. This can be achieved in two ways, firstly by tying the material to the fibers by means of a chemical bond, and secondly by incorporating the material in the melt from which the fibers are spun.

With regard to the former method, a chemical bond may be formed by substitution of the amide hydrogen in a polyamide fiber. This may be effected by the reaction of a polyamide with an isocyanate from a solvent solution (chlorinated hydrocarbon such as perchloroethylene or trichloroethane). In one example, the dry washed fiber is treated with a solvent solution of 5% triphenyl methane tri-isocyanate. After immersion, the fiber is spun dry, placed in an airtight container and allowed to stand for a few hours or overnight. The fiber is washed in further solvent, immersed in a pre-polymer of polydimethyl siloxane, and spun dry. Solvent is removed by evaporation and the fiber is cured at 100°–150° C. Alternative processes involve the use of 2,4 or 2,6 tolylenediisocyanate and various fluoro compounds such as vinyl fluoride or 1,1-dihydroperfluorooctyl methacrylate.

A chemical bond can also be formed by peroxidation of a polymer to produce a polyfunctional initiator. One such method is described in German Pat. No. 2151755. The fiber is immersed in a 5% solution of 1,1 dihydroperflorooctylacrylate in perchloroethylene together with 5% tertiory butylperoxide. The fiber is spun-dried, the temperature is then raised to 125° C. over the next 20 mins. and held at this temperature for a further 15 mins. Other oxidizing agents suitable for initiating this process include di benzoyl peroxide (German Pat. No. 1900234) and various per acids such as peracetic, persulphates, perborates hydrogen peroxide and various cerium salts. Ozone is particularly suitable especially when used in air at 100° C. for 10 mins. prior to treatment with a polymerizable hydrophobic compound such as polymethylsiloxane, vinyl fluoride and other fluoro compounds.

A still further method of forming a chemical bond involves the treatment of a fiber, particularly nylon, a polyolefin or polyester, with difluorocarbene (difluoromethylene $CF_2$) generated by pyrolysis of sodium chlorodifluoroacetate or chlorodifluoroacetic acid. In one example, the fiber known by the trade name NOMEX is treated with a solution of the sodium salt in water and the water is then removed by evaporation. Heating to 250° C. causes pyrolysis and production of $CF_2$ vapour which modifies the surface of the fiber to give a more hydrophobic surface. The acid is applied from a chlorinated hydrocarbon solvent solution.

With regard to the provision of hydrophobic properties by incorporation of an appropriate material in the melt from which the fibers are formed, one suitable material is a silicone oil which is a prepolymer of polymethyl siloxane. A substance found suitable for this application is type F132 marketed by ICI Ltd. Such silicone oil when incorporated in polypropylene fiber can reduce the critical surface tension from 32 dynes/cm to 26 dynes/cm. Alternative additives include fluorochemicals, for example a compound which has 1-4 fluoroalkyl groups attached to an organic radical as disclosed in U.S. Pat. No. 3,767,625.

Where the hydrophobic layer comprises a wad of fibers held together and/or to a backing layer by a resin or elastomer, the resin or elastomer may be such as to provide the hydrophobic properties.

In the case where the hydrophobic layer is made up of fibers having hydrophobic characteristics, such fibers need not constitute the entire hydrophobic layer but instead may constitute only part thereof, being mixed with other fibers. This arrangement may be employed in the case where hydrophobic fibers, such as PTFE fibers, are employed. PTFE fibers have the desired hydrophobic properties but are not wholly satisfactory in other respects. Thus PTFE fibers have very low flexural rigidity and recovery characteristics compared with polyamide, polyester, polypropylene and wool fibers. Further, PTFE fibers have low tensile strength, typical tensile strengths in gms per denier being 1.8–2.0 for PTFE, 4.1–5.6 for polyamide, 4.0–5.0 for polyester and 4.5–6.0 for polypropylene. Still further PTFE fibers have poor abrasion properties, are difficult to handle during textile processing and are expensive and are available in a limited range of deniers. These drawbacks can be overcome to a certain extent by admixture of other fibers, in some cases hydrophilic fibers, with the PTFE fibers.

Examples of the invention will now be described. In the Examples:

$$\text{\% Moisture content in paper} = \frac{\text{Weight of paper} \times 100}{\text{Weight of water} + \text{weight of paper}}$$

EXAMPLE 1

On a ten meter long conventional woven press felt 0.6 meters wide a length of one meter was treated across the full width of the felt with a solvent based solution of an air-drying polymethyl siloxane type compound (M492 marketed by ICI Ltd.) which was self curing.

The felt was installed on the 2nd press of a small paper machine manufacturing paper of 105 gsm at a rate of 30.5 mpm. Moisture measurements by gravimetric and microwave detection methods indicated a moisture content of the paper sheet where the sheet contacted the treated area of the felt of 57.75% whereas the content of the sheet on the untreated area of the felt was 61.25% giving a reduction of 3.5% in moisture content of the sheet. All subsequent reductions in moisture content quoted in the following Examples are similarly computed.

EXAMPLE 2

An endless wet press felt was formed comprising:

(i) A plain weave fabric constructed from yarns of synthetic fibers (polyester and polyamide yarns at 26 picks and ends per inch) with a total weight of 680 g/m$^2$;

(ii) An intermediate layer of 10 denier polyamide (nylon 6) 60 mm staple fiber at a weight of 330 g/m$^2$;

(iii) A surface layer of 6 denier 60 mm polypropylene staple fiber at a weight of 210 g/m$^2$.

The felt was constructed by a conventional needling technique whereby the fiber was carded and cross-layed prior to needling. Afterwards the felt was washed and then dried, on a stretcher device consisting of two rollers one of which was capable of being steam heated.

An air-curing type polydimethylsiloxane compound was applied to the polypropylene surface of the fabric, from a chlorinated hydrocarbon type solvet (such as 1,1,1-trichloroethane) by means of a lick roller applicator.

A total of 2% solids by weight was applied to the polypropylene surface. The silicone penetrated to a depth of 1 mm of a felt which had a total thickness of 2.0 mm (before use) under a load of 40 KN m$^{-2}$.

The performance of this felt was tested in a press having plain rollers at a speed of 150 mpm and at a pressure of 70 Kg/cm, the rollers having a face width of 1 meter.

Comparison of the performance of this felt was carried out against a felt of similar construction but without being treated.

The felt constructed according to the Example of the invention gave, after an initial running-in period a reduction of 2.5% in the moisture content of the sheet leaving the press over the moisture obtained using the untreated felt.

For this test the paper sheet was in contact with the felt on emergence from the nip.

EXAMPLE 3

A felt was constructed in a manner similar to that used in Example 2 except that the polypropylene fiber was treated with a silicone water repellent compound while the fiber was in staple form. The method of treatment was as follows:

Wash the fiber in water.

Spin dry and then dry in hot air.

Immerse in a 8% (by volume) solution of a prepolymer of a poly dimethyl siloxane compound including an organometallic catalyst in a solution of 1,1,1-trichloroethane. The fiber was spun-dried and the solvent evaporated by warm air at 60°-80° C. Curing was then effected at 110° C. for 5 mins.

The performance of the felt was tested at 150 mpm and 70 Kg/cm (as with Example 2) and gave an improvement in moisture removal of paper entering the nip of a plain press at 72% moisture content, over a control felt using a surface layer of polyamide fibers of 3.0% to 3.5% after an initial running-in period.

The felt was also tested on the 4th press of a paper making machine at 520 meters/min. and 75 Kg/cm. The roll in contact with the felt was of a grooved type known in the trade as a "VENTA PRESS" roll. A 2.0% reduction of the paper moisture level was noted when compared with similar felts not having a hydrophobic surface layer.

EXAMPLE 4

An endless wet press felt was constructed comprising:

(i) A plain weave fabric as in Example 2;

(ii) An intermediate layer of 18 denier 150 mm staple nylon at a weight of 390 g/m$^2$;

(iii) A surface layer of 3 denier 60 mm polyamide staple fiber at 150 g/m$^2$.

The 3 denier polyamide surface fiber was treated while in a staple form to produce a water repellent effect by the following method.

(a) The fiber was washed in warm water, spun dried and dried in warm air.

(b) The fiber was then immersed in a 9% solution of pentadecafloroctylacrylate and 3% tertiary-butylperoxide added. The solvent used was 90 parts perchloroethylene with 10 parts tetrachloroethane. The temperature was raised to 110° C. (during 20 mins.) by recirculating the vapor over the fiber in a closed container and was given another 5 mins. treatment at this temperature.

The performance of this felt was tested in a single plain press at 150 meters/min. at 70 Kg/cm and the results compared with another similar felt in which the fibers had not been treated.

When the paper was removed from the press with the felt in contact with the paper, the hydrophobic felt gave a 3.0% improvement in moisture removal over the untreated felt after an initial running-in period.

When the sheet was removed from the top roll of the press the water removal improvement was 5.0% after an initial running-in period.

EXAMPLE 5

An endless wet press felt was constructed with 3 layers as described in previous Examples, with the fiber and base cloth of similar weights to Example 4 but in this instance utilizing 3 denier polypropylene for the surface layer and a blend of 60 parts 15 denier polypropylene and 40 parts wool fiber for the intermediate layer. The 6 and 15 denier polypropylene fiber were treated in the following manner prior to blending and needling on to the base cloth.

The fiber was washed and dried then treated in a closed chamber in which air was circulated at 100° C. Ozone was passed into the system to give approximately 0.5% by volume. After 10 mins. the fiber was immersed in a solution of polydimethyl siloxane including an organo-metallic catalyst in 1,1,1-trichloroethane. The catalyst was in a 1:5 ratio and the prepolymer compared with a normal 1:3 combination. This was then spin dried and the temperature raised to 110° C. over the next 25 mins.

The performance of this felt was similar to that of Example 4.

EXAMPLE 6

With another type of endless wet felt consisting of a lightly needled wad of fibers held together by means of a binder, the use of a hydrophobic binder caused an improvement in the water removal capability.

An endless wad of lightly needled 10 denier 60 mm long staple nylon 6 fiber at 600 g/m$^2$ was impregnated with a silicone elastomer in a solvent mixture of Toluene/methyl ketone (1:1) with a total solids content of 400 g/m$^2$. The solvent was evaporated and the "felt" compressed to 3 mm during the curing operation.

A comparison of the water removal characteristics of the 2 felts showed that at 120 meters/min. and a pressure of 45 Kg/cm in a plan press; a moisture removal improvement of 2.5% was obtained above that obtained with a felt not using the hydrophobic binder.

SPECIFIC DESCRIPTION

Figure 1:
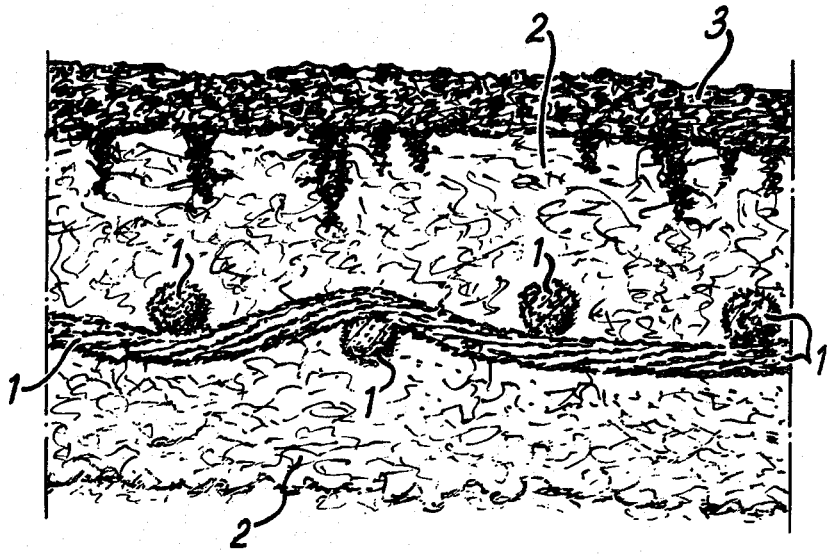
FIG. 1 is a diagrammatic sectional view of one form of a paper makers' felt according to the invention.

In FIG. 1, reference numeral 1 indicates threads of a woven backing layer, reference numeral 2 indicates a wad of fibers needled to the backing layer to provide a hydrophilic (or less hydrophobic intermediate layer), and reference numeral 3 indicates a surface layer of hydrophobic fibers.

Figure 2:
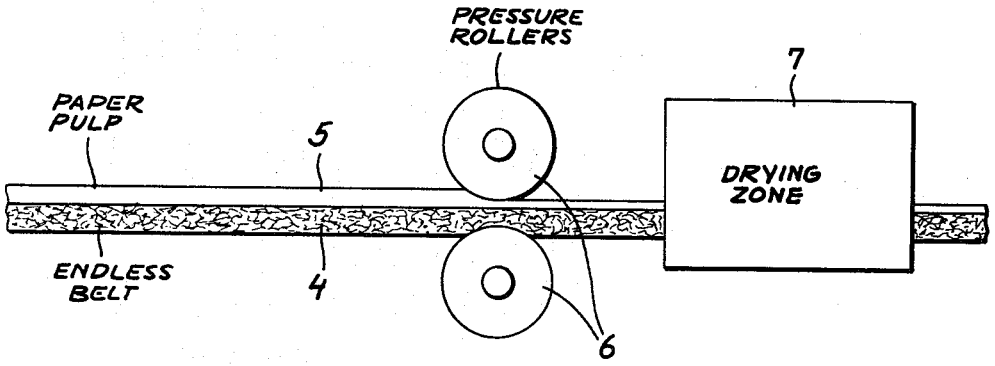
FIG. 2 is a diagrammatic view of a portion of a paper making apparatus incorporating the present invention.

FIG. 2 shows the endless belt 4 conveying the paper pulp 5 through the pressure rollers 6 where a major portion of the water contained in the wet paper pulp is removed prior to entering a drying zone 7 where the remaining moisture is removed from the pulp 5.

What I claim is:

1. In a papermaking apparatus of the type having a movable endless belt conveying a wet web of paper between a pair of pressure rollers for driving water out of said web and then passing said web to a drying zone for removing additional water from said web, the improvement wherein said belt comprises:

a surface layer formed from water absorbent non-woven fibrous material, and a backing layer coarser than the surface layer and formed from water absorbent wads of separate fibers, said surface layer having hydrophobic properties in that said surface layer has a critical surface tension less than 33 dynes/cm, and said surface layer being held in intimate contact with said backing layer with fibers of said surface layer penetrating and needled into said backing layer to integrate said layers so that water forced into said surface layer by said pressure rollers is readily taken up by both said layers to be retained thereby.

2. The improvement defined in claim 1 wherein said surface layer and said backing layer have inter-fiber spaces of substantially the same size.

3. The improvement defined in claim 1 wherein the fibers forming said surface layer are of a finer denier than the fibers forming said backing layer.

4. The improvement defined in claim 1 wherein the fibrous material of said surface layer is bound together by a resin.

5. The improvement defined in claim 1 wherein the fibrous material of said surface layer is bound together by an elastomer.

6. The improvement defined in claim 1 wherein at least some of the fibrous material of said surface layer is formed from an intrinsically hydrophobic material.

7. The improvement defined in claim 1 wherein said hydrophobic material of said surface layer is mixed with hydrophilic material.

8. The improvement defined in claim 1 wherein the fibrous material of said surface layer is provided with a hydrophobic material bound to the outer surface of the fibrous material.

9. The improvement defined in claim 1 wherein the fibrous material of said surface layer has a hydrophobic material bound chemically thereto.

* * * * *